United States Patent [19]

Cole

[11] Patent Number: 4,585,434

[45] Date of Patent: Apr. 29, 1986

[54] TOP LOADING SWINGING BUCKET CENTRIFUGE ROTOR HAVING KNIFE EDGE PIVOTS

[75] Inventor: Paul M. Cole, Wilmington, Del.

[73] Assignee: E. I. Du Pont de Nemours and Company, Wilmington, Del.

[21] Appl. No.: 656,645

[22] Filed: Oct. 1, 1984

[51] Int. Cl.[4] ..... B04B 5/02

[52] U.S. Cl. ..... 494/20

[58] Field of Search ..... 494/16, 20, 17, 18; 422/72

[56] References Cited

U.S. PATENT DOCUMENTS

| | | |
|---|---|---|
| 263,053 | 8/1882 | McCollin . |
| 1,839,944 | 1/1932 | Barthels . |
| 1,997,919 | 4/1935 | Strezynski . |
| 3,361,343 | 1/1968 | Lerner . |
| 3,393,864 | 7/1968 | Galasso et al. . |
| 4,400,166 | 8/1983 | Chulay et al. . |
| 4,435,167 | 3/1984 | Stower . |

FOREIGN PATENT DOCUMENTS

| | | |
|---|---|---|
| 1782602 | 3/1972 | Fed. Rep. of Germany . |
| 296421 | 2/1954 | Switzerland . |
| 505446 | 5/1939 | United Kingdom . |

*Primary Examiner*—Robert W. Jenkins

[57] ABSTRACT

A top loading swinging bucket centrifuge rotor is characterized by the provision of a sample container knife edge pivot element which engages the sample container along a substantially line contact as the container pivots from an initial to a second position. The container may be inserted into the rotor such that any diametrical dimension thereof is aligned with the line contact, thus avoiding the necessity of orienting the container with respect to the rotor. A guide slot for guiding the motion of the container is disposed radially inwardly of the pivot elements.

12 Claims, 7 Drawing Figures

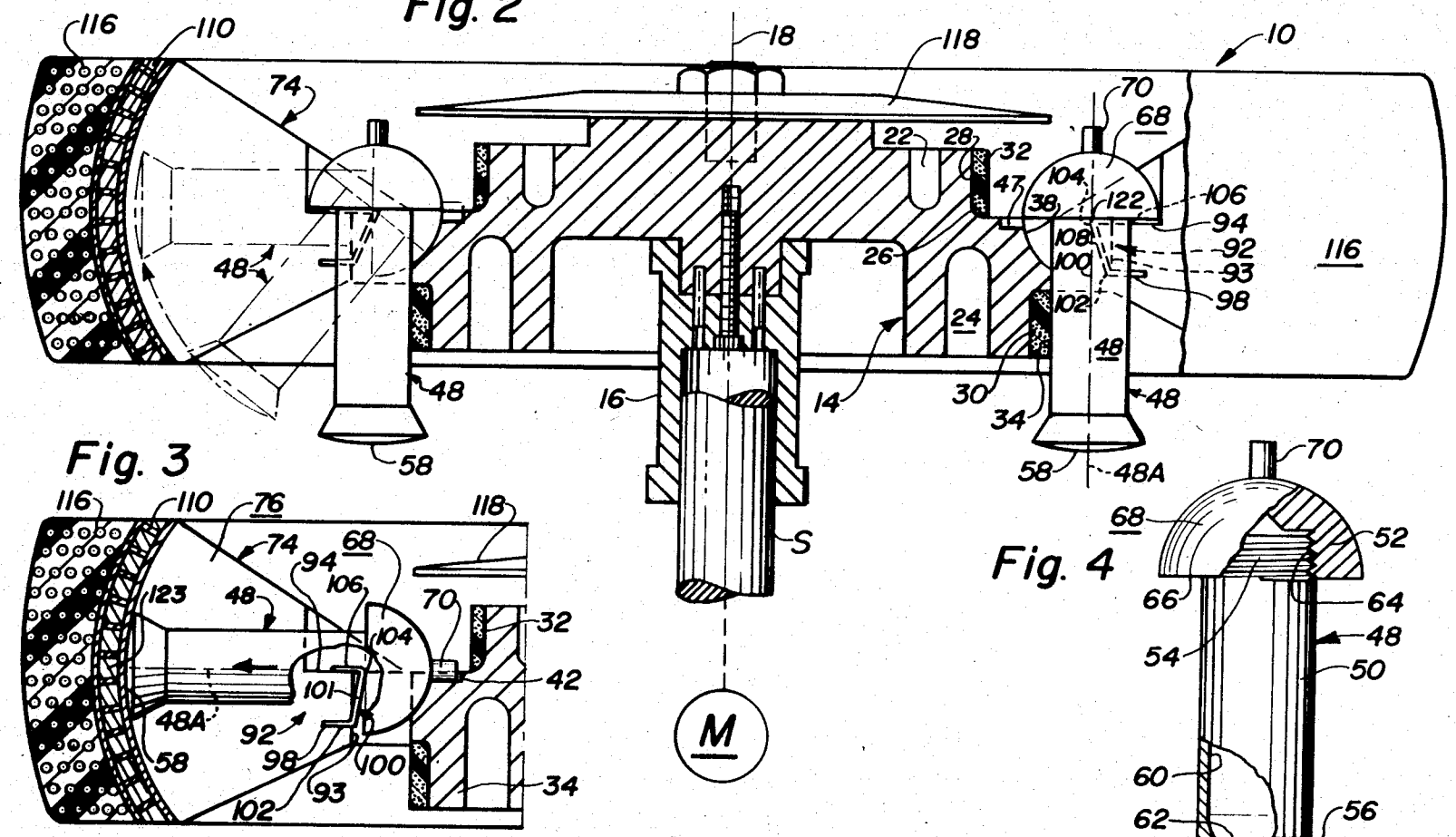
Fig. 2
Fig. 3
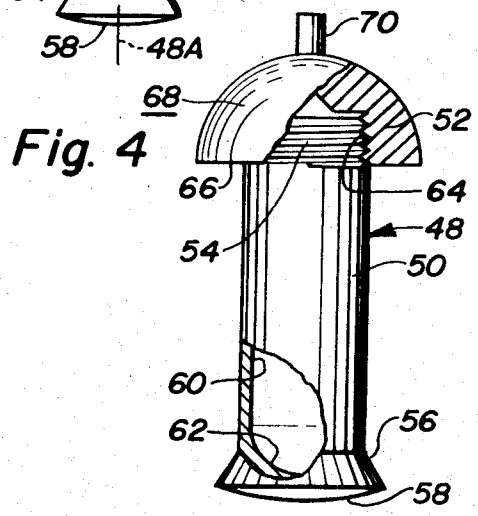
Fig. 4

TOP LOADING SWINGING BUCKET CENTRIFUGE ROTOR HAVING KNIFE EDGE PIVOTS

FIELD OF THE INVENTION

This invention relates to a centrifuge rotor of the swinging bucket type and, in particular, to a top loading swinging bucket centrifuge rotor having knife edge trunnion pivot elements.

CROSS-REFERENCE TO RELATED APPLICATIONS

Subject matter disclosed herein is disclosed in the following copending applications:

Sample Container For A Top Loading Swinging Bucket Centrifuge Rotor, Ser. No. 656,644, filed Oct. 1, 1984; and Centrifuge Rotor Having A Load Transmitting Arrangement, Ser. No. 656,646, filed Oct. 1, 1984.

DESCRIPTION OF THE PRIOR ART

A centrifuge rotor of the type in which a sample container carrying a sample of the material to be centrifuged moves from an initial position in which the axis of the sample container is substantially parallel to the vertical center line of the rotor to a second position in which the axis of the sample container lies substantially in a plane perpendicular to the vertical center line of the rotor is known as a swinging bucket rotor.

In one typical arrangement, the sample container, or bucket, used with such rotors typically includes outwardly projecting elements, or trunnions, having a portion thereof defining a substantially cylindrical bearing surface. The trunnion pins are typically received in corresponding support arms that are provided with conforming tunnion receiving sockets. Alternatively, trunnion pins may be located on the arms with the corresponding sockets being disposed on the container.

In either event the bearing surface on the trunnion pin bears against the surface of the trunnion receiving socket in which it is received throughout the pivotal movement of the sample container from the initial to the second position. The trunnion receiving socket therefore acts both as the surface which supports the bearing surface on the trunnion pin and the constraining and guiding surface which insures the controlled movement of the sample container from the initial to the second positions. U.S. Pat. No. 4,400,166 (Chulay et al.), U.S. Pat. No. 3,393,864 (Galasso et al.), U.S. Pat. No. 263,053 (McCollin) and Swiss Pat. No. 296,421 (Willems) disclose typical examples of such rotors.

Trunnion pin systems are generally complex and costly. A sample container should preferably be a lightweight structure to minimize centrifugal loading on the rotor. However, the presence of trunnion pins cantilevered from a sample container requires a substantial anchorage in the container structure, necessitating an undesirable increase in the weight of the container. In addition, when loading the sample container into the rotor the presence of the trunnion pins require locating the container in a precise orientation with respect to the rotor. This can present, at a miminum, an inconvenience to an operator. Moreover, as is developed herein, misorienting the container with respect to the rotor can have more deleterious consequences.

The abrading action which occurs between the bearing surface on the trunnion pin and the socket is also believed to be disadvantageous for several reasons. First of all, the abrasion results in the wearing of metal which must be closely monitored. To counteract this result hardened materials are used for the pins and the supports. Furthermore, trunnion pins require the structures exhibit relatively large radii in order to reduce trunnion stress and contact stress.

In U.S. Pat. No. 4,435,167 (Stower) an alternative support arrangement is disclosed which eliminates the above-discussed abrading action by use of a rolling profile to engender rolling action between one or more profiled surfaces. However, such an arrangement appears to prevent orientation of the container with its axis completely parallel to the vertical axis of the rotor. A rolling profile precludes the axis of the sample container from reorienting to a true vertical position after centrifugation. At zero rotational speed the sample container will hang in a true vertical position only if the line of restraint is directly in vertical alignment with the center of gravity of the sample container on the centerline of the container. The line of restraint is that location where the forces acting on the center of mass of the container resist movement. Likewise, under high speed rotation the container will assume a horizontal orientation only if the line of restraint is in the horizontal plane of the center of gravity of the container. Since the center of gravity does not change relative to the axis of the container and the use of a rolling profile does alter the point of restraint relative to this axis, the above requirements are mutually exclusive. Since it is desirable in operation to have the axis of the sample container align with the centrifugal force field, it follows with the Stower structure that as the rotor slows and stops the axis of the container will not hang in a true vertical position. Thus, at least in gradient operations, the possibility of unsettling the gradient in the container exists unless the user, when removing the container, is careful to keep it at the same orientation as existed when the rotor stopped.

Accordingly, in view of the foregoing, it is believed advantageous to provide a mounting arrangement for supporting the pivotal motion of the sample container from the initial to the second positions which eliminates the shifting of the container's line of restraint as exhibited by the prior art.

As alluded to earlier, prior art trunnion systems require that the sample container be accurately oriented and mounted on the trunnions. However, this requirement is not always fulfilled in practice. Thus, sample containers are misplaced on the rotor. The majority of rotor mishaps can be traced to the misorientation of the sample container on the rotor.

Accordingly it is believed to be of further advantage to provide a top loading centrifuge rotor in which the requirement of container orientation with respect to the rotor is totally eliminated. That is, a rotor in which a sample container may be expeditiously inserted without the necessity of verifying the position of the container with respect to the rotor should be significantly advantageous in reducing the occurrence of rotor mishaps.

SUMMARY OF THE INVENTION

The present invention relates to a centrifuge rotor of the swinging bucket type and comprises a pair of sample container pivot elements disposed in circumferentially spaced relationship about the rotor. Each pivot element is arranged to define a thin knife edge adapted to receive the pivot surface of a sample container along a substantially line contact. The rotor is arranged such that the sample container may be loaded into the rotor from the top without the necessity of orienting the container on the pivot surfaces. That is, the container may be inserted into the rotor such that any diametrical dimension of the surface may lie coincident with the line contact defined by the pivot edges.

A guide surface is disposed on the rotor radially inwardly of the pivot element and cooperates with the outer configuration of the sample container to guide the same as it pivots with rotation of the rotor on the line of contact with the pivot elements through a portion of its travel from the initial to the second position. Preferably the pivot elements are mounted within the rotor and designed such that when the sample container reaches the second position centrifugal force effects cause the pivot elements to deflect to an extent which permits the sample containers to move radially outwardly and thereby bring their radially outer surfaces into a force transmitting relationship with a stress confining band which may be provided about the rotor. A stop surface communicating with the guide surface prohibits motion of the sample container past the second position.

BRIEF DESCRIPTION OF THE DRAWINGS

The invention will be more fully understood from the following detailed description thereof taken in connection with the accompanying drawings which form a part of this application and in which:

FIG. 2 is a sectional view taken along section lines 2—2 of FIG. 1;

FIG. 3 is a view similar to a portion of FIG. 2 showing a sample container in the second position with the pivot support element in the deflected condition;

FIG. 4 is an elevational view of the sample container used in each embodiment of the present invention with portions broken away for clarity;

DETAILED DESCRIPTION OF THE INVENTION

Figure 1:
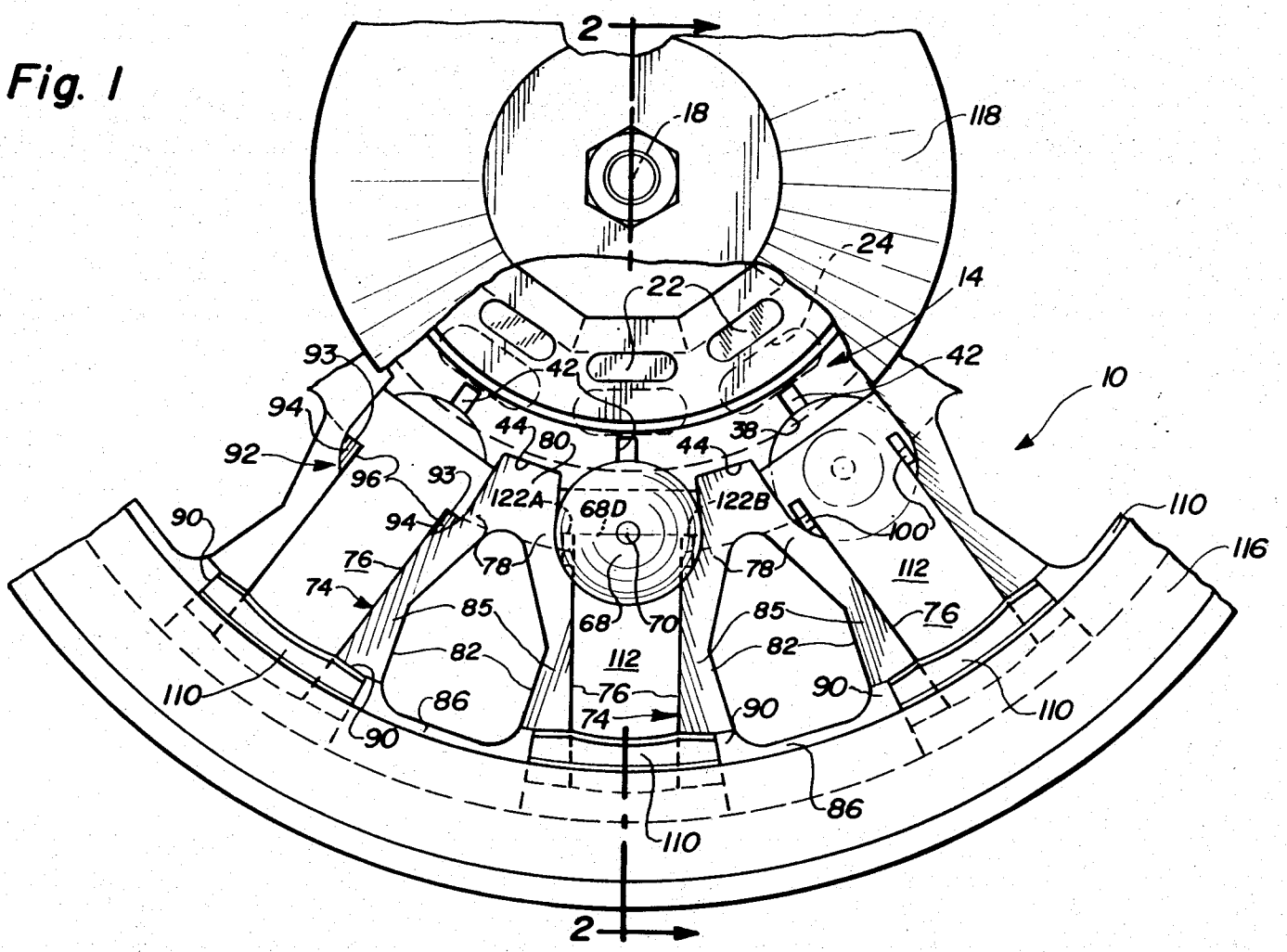
FIG. 1 is a plan view of a top loading swinging bucket centrifuge rotor in accordance with the preferred embodiment of the invention.

Throughout the following detailed description similar reference characters refer to similar elements in all Figures of the drawings.

With reference to FIGS. 1 and 2 respectively shown is a plan view of a portion of a top loading centrifuge rotor generally indicated by reference character 10 embodying the teachings of the present invention and a side sectional view of the same.

The rotor 10 includes a generally annular core 14 that receives in driving engagement a drive adapter 16. The drive adapter 16 serves as the interconnecting element through a shaft S whereby the rotor 10 is connected to a centrifuge drive motor M (shown schematically) to rotate the rotor 10 about its vertical axis 18. Of course, any suitable form of interconnection between the rotor 10 and its motive source may be used.

The core 14 if fabricated of material such as aluminum, titanium or plastic. The core 14 serves to locate and transmit torque to those elements (to be described) disposed outwardly therefrom. The core should be as lightweight as possible in order to maximize its strength to weight ratio and to minimize stresses during high speed rotation. To decrease the weight the core 14 is provided with arrays of cutouts 22 and 24 on its upper and lower surfaces respectively. The outer peripheral surface of the core is stepped as at 26 (FIG. 2) to define upper and lower cylindrical portions. The upper cylindrical portion and the lower cylindrical portion are each provided with a notch 28 and 30, respectively. Each of the notches receives a supporting wrapping 32 and 34, respectively. The wrappings 32, 34 are fabricated of a composite fiber material such as an aramid fiber manufactured and sold by E. I. du Pont de Nemours and Company under the trademark KEVLAR®. Each fiber is impregnated with a resinous material, such as epoxy or the like, and wrapped to form stress confining wrappings 32, 34 to enhance the strength-to-weight ratio of the core 14. The wrappings 32 and 34 may, of course, not be necessary if the core material is itself a sufficiently high-strength material, as titanium.

An array of spherical cutouts 38 is arranged around the periphery of the lower cylindrical portion of the core 14. Communicating with the head of each cylindrical cutout is a substantially cylindrical channel 42. The purpose of the cylindrical channels 42 will be described in more detail herein. Interposed between adjacent ones of the cutouts 38 are rectangular notches 44 (FIG. 1) for a purpose which will be also set forth herein. The number of cutouts 38, channels 42 and notches 44 corresponds to the number of sample containers carried by the centrifuge rotor 10.

Referring to FIG. 4 shown in side elevation with a portion broken away in a sample container 48 used with the present invention. The sample container 48 has a longitudinal axis 48A and includes a substantially cylindrical body portion 50 threadily attached to a cop 52. The body 50 is a substantially tubular member preferably machined from titanium or other suitable material. The upper end of the body 50 is provided with external threads 54. The lower end of the body portion 50 flares through a frustoconical region 56 to a stress distributing spherical end region 58. The radius of the spherical end 58 matches that of a force distributing member 110 disposed about the outer periphery of the rotor. The interior of the body portion 50 is configured with cylindrical sidewall 60 with a spherical end 62 which combine to provide a typical test tube shape to the interior of the body 50. Of course, the contour of the interior of the body 50 may take any desired shape.

The cap 52 is a hemispherical member, preferably fabricated from nylon or other suitable material, having an internally threaded bore 64 adapted to receive the external threads 54 of the body 50. The annular planar undersurface 66 of the cap 52 defines a pivot surface operative in a manner set forth herein. The exterior surface of the cap 52 defines a surface 68 topped by an axially extending cylindrical stop pin 70. The pin 70 also conveniently serves as a handle for the container 48. The contour of the surface 68 corresponds in shape to the shape of the surface of the spherical cutouts 38 provided in the core 14. Similarly, the exterior contour of the pin 70 conforms to the contour of the cylindrical channels 42 provided in the core 14.

As seen with reference to FIGS. 1 and 2 arranged circumferentially about the core 14 is an array of force transmitting segments 74 preferably formed from a strong, light weight material, such as a polyester engineering thermoplastic resin such as that manufactured by E. I. du pont de Nemours and Company, and sold under the trademark RYNITE®. Each segment 74 is a substantially sector of wedge shaped member having generally radially extending sidewalls 76 which taper through converging curved portions 78 towards a generally rectangular key portion 80. Each key portion 80 is configured for a close fitting relationship with one of the notches 44 peripherally arranged about the core 14. The segment 74 is cut-out to form a recess 82 to eliminate that extra mass unnecessary to the performance of its pivot support and structural interconnection functions, as will be described. The recess 82 formed on the segment 74 defines a pair of generally radially extending struts 85 joined by an arcuate connecting land 86. The end of each strut 85 is stepped at its radially outer end, as at 90, for a purpose made clear herein.

As perhaps best seen in FIG. 3 in which a portion of the sample container 48 is broken away, each sidewall 76 of a segment 74 is provided with a step 92 defined by a substantially vertical planar shelf 93, a horizontal shelf 94 and a radially planar portion 96 (FIG. 1) extending radially inwardly from sidewall 76. A notch 98 (FIGS. 2 and 3) is provided into the step 92 to receive and to secure one end of a resilient pivot element 100.

The pivot element 100 is formed of a high strength resilient material, such as stainless spring steel or the like, and takes the form when in its developed state of a rectangular strip 101. One end of the strip 101 is inserted into the notch 98 and is secured thereto by any suitable means of attachment. The strip 101 is bent at a lower elbow 102 adjacent the lower surface of the step 92 and slants vertically and radially inwardly to a second, upper, bend 104, whereat the strip 101 is bent backwards to define a portion 106 which overlies the shelf 94 of the step 92. The upper bend 104 of the strip 101 defines a thin knife edge-like pivot support for the sample container 48. The undersurface of the strip 101 intermediate the bends 102 and 104 defines a predetermined clearance space 108 (FIG. 2) with the vertical planar face 93 of the step 92 for a purpose discussed herein. The knife edge-like pivot support may be defined in a variety of ways. One such alternative is described herein in connection with FIGS. 5 through 7. Any other alternatives constructions whereby the knife edge pivot support is defined are to be understood as lying within the contemplation of the present invention.

The circumferential distance between the radially outer ends of the struts 85 of adjacent segments 74 is closed by a shell-like distributor element 110. The circumferential ends of the shell 110 are received in the steps 90 provided on confronting struts 85 on angularly adjacent segments 74. The inner surface of the distributor shell 110 is concavely spherical, as seen from FIGS. 2 and 3. The shell 110 is preferably fabricated in a honeycomb fashion from perforated sheets of aluminum bounded by solid shaped plates of aluminum. Any other suitable construction may be used.

Adjacent segments 74 are keyed into the corresponding notches 44 on the core 14 to define the circumferentially spaced array thereof. The spaces between confronting surfaces 76 of angularly adjacent segments 74 together with the distributor 110 cooperate to define a pocket or region 112 adapted to receive and support a sample container 48 during rotation thereof. As discussed herein, the pocket 112 is accessible to an operator for top loading of a sample container 48.

The above structural elements of the rotor are maintained in their described assembled relationship by circumferentially extending band 116 of fiber composite material, such as the aramid fiber similar to that used to form the wrappings 32 and 34. The wrappings 32 and 34 as well as the band 116 are formed of a composite material such as epoxy coated aramid fiber manufactured and sold by E. I. du Pont de Nemours and Co. Inc. under the trademark KEVLAR®. The fiber is uniformly traversed over the dimension of the member through that number of turns required for a given radial depth. The assembly is then placed in an autoclave and the temperature elevated to a suitable level and held for a predetermined time to cure the epoxy. Of course, any other suitable wrapping material and/or means of wrapping or banding the rotor may be utilized. Each segment 74 serves to connect the radially outer distributor plates to the core and thus serves as structural interconnection for the rotor much like the spokes of a wheel interconnect the rim to the hub. A cover 118 may be connected to the rotor, as by a threaded connection, if desired.

In operation, a sample of material to be subjected to a centrifugal force field is introduced into the interior of the sample container 48 and the cap 52 thereof secured to the body portion 50. Sample containers 48 are top loaded in a balanced manner into diametrically opposed ones of the pockets 112 arranged around the periphery of the rotor 10. Each container 48 is supported in its pocket 112 along an interrupted line contact 122 shown in FIG. 1 by the characters 122A and 122B. The interrupted line of contact 122 is defined between the knife edge provided by the upper bends 104 of the pivot support element pair 100 mounted on the step 92 on angularly confronting sidewalls 76 of adjacent segments 74 and the adjacent corresponding portion of the annular undersurface 66 of the cap 52 of the sample container 48. Preferably, the line contact 122 so defined extends substantially coincident with a diametrical dimension 68D of the pivot surface 66 of the carrier 48. Any one of the diametrical dimensions defined across the pivot surface 66 may be coincident with the interrupted line of contact 122. Alternately stated, the container 48 may be introduced into the rotor so that any diameter of the pivot surface 66 aligns with the knife edge pivots. The container 48 need not be oriented with respect to rotor. Thus, the primary cause of mishap—misalignment of the sample container—is avoided using the teachings of the present invention.

With each container 48 in its initial position (as shown in solid lines in FIG. 2) motive force is applied to the rotor causing the same to spin about the vertical axis 18. Increasing rotational speed causes the sample container 48 to pivot on the line contact 122 as above defined and to move from the initial position in which the axis 48A of the sample container 48 lies substantially parallel to the spin axis 18 of the rotor to a second position (shown in dotted lines in the left half of FIG. 2) in which the axis 48A of the container 48 lies in a plane substantially perpendicular to the spin axis 18. Throughout this pivotal motion only the interrupted line contact 122 defined between the undersurface 66 of the head 52 of the sample container 48 and its associated pair of pivot support elements 100 is maintained. Thus, the point of restraint defined by the line contact 122 remains the same throughout the pivotal movement of the container 48. As a result both the abrading contact between the trunnion pins and the sockets and the rolling action present in the various prior art swinging bucket rotors is advantageously avoided.

Throughout its motion from the initial to the second position (shown in dot-dash lines in FIG. 2) the lower spherical end 58 of the container 48 remains radially inwardly of the inner spherical surface of the distributor shell 110. Guidance of the sample container 48 over a portion of its travel from the initial to the second position may be effected using a structure similar to a portion of the structure discussed in connection with FIGS. 5 through 7. Such guidance structure is provided in the rotor core 14 at a point radially inwardly of the pivot element 100. Motion of the sample container 48 beyond the second (horizontal) position shown in FIG. 2 is arrested by the engagement of the cylindrical stop pin 70 of the container 48 into the corresponding cylindrical channel 42 provided in the core 14.

The spring element 100 is suitably designed to deflect in such a manner that the container 48 is substantially horizontal before the spherical end 58 of the container 48 contacts the inner spherical surface of the shell 110. As the rotor spins, the container 48 pivots while the spring 100 deflects. Once horizontal the increasing centrifugal force on the container 48 continues the deflection of the spring 100 in a radially outwardly direction to close the clearance gap 108 to thereby cause the undersurface of the mid-portion of the pivot element 100 to approach into close adjacency to the vertical face 93 of the step 92. This brings the spherical surface 58 of the sample container 48 into force transmitting contact, shown at 123 (FIG. 3), with the inner surface of the distributor shell 110 and thereby into a force transmissive relationship with the band 116 wrapped around the rotor 10. By judiciously selecting the material and geometry of the container 48 the centrifugal loading on the band 116 from the container 48 through the distributor shell 110 is approximated by the load imposed on the band 116 by the segments 74.

The abutment between the bottom surface 58 of the sample container 48, through the distributor shell element 110, has the tendency to more uniformly load the band 116 and thereby prevent the imposition of localized stresses on the band 116 which, in the absence of the distributor elements 110 would appear as essentially a small area contact between the container and the band.

Figure 5:
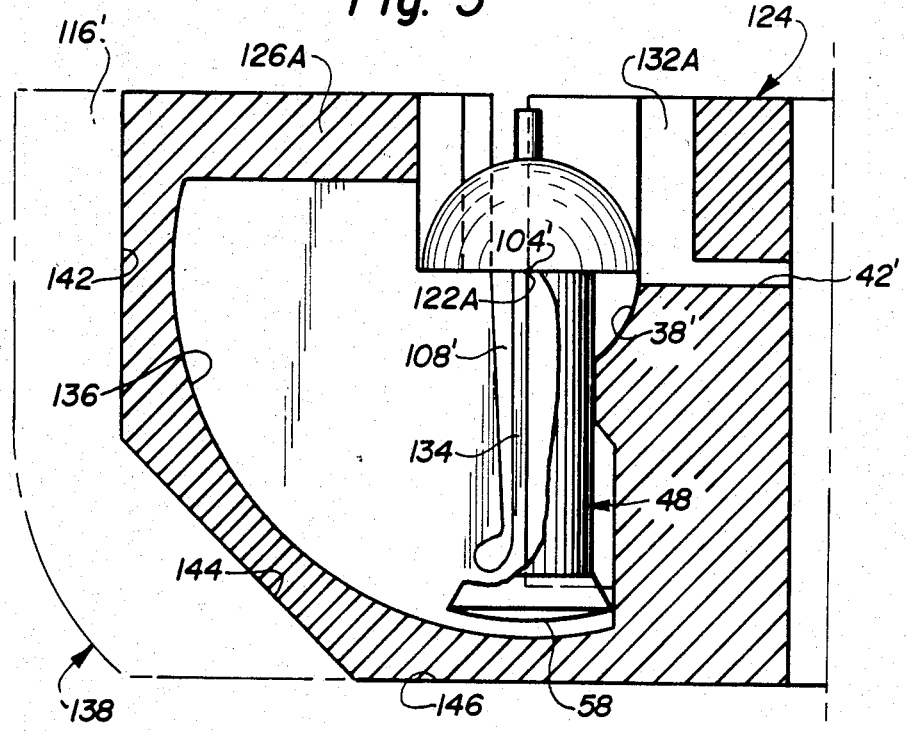
FIG. 5 is a side sectional view of a sample container carrying assembly in accordance with another embodiment of the invention.
Figure 6:
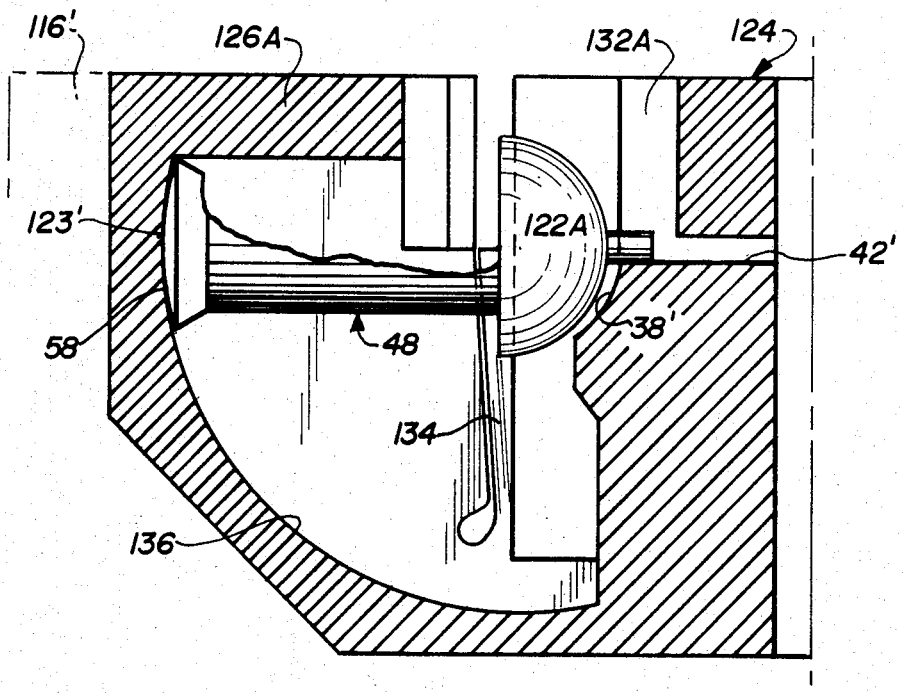
FIG. 6 is a view similar to FIG. 5 showing the sample container carrying assembly with the pivot support element in the deflected condition.
Figure 7:
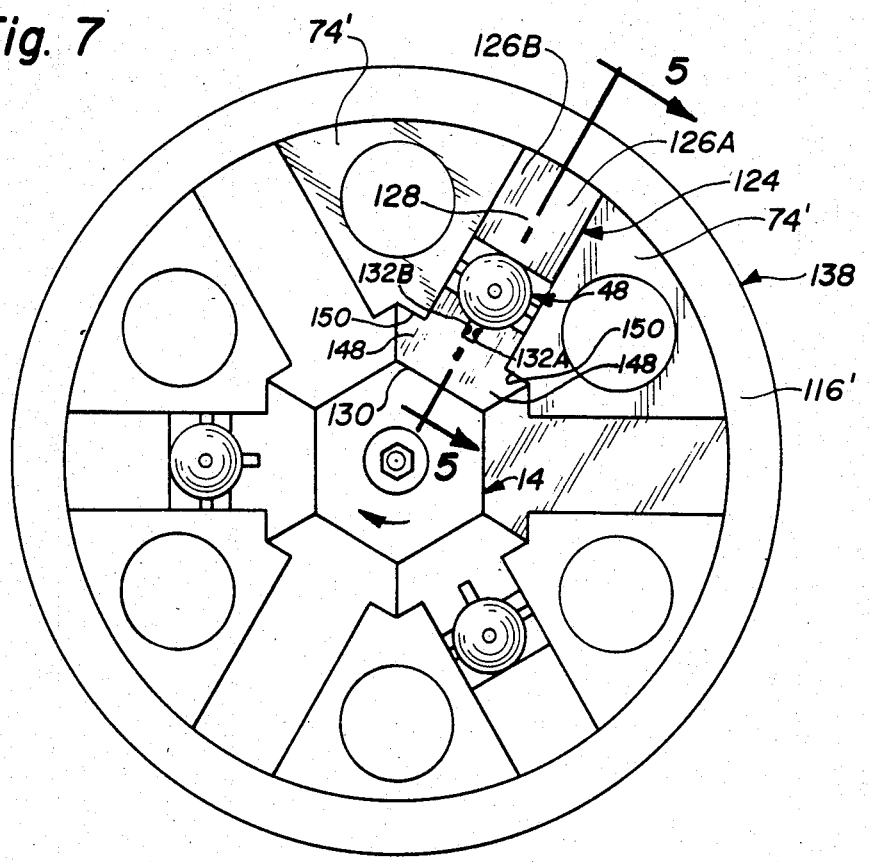
FIG. 7 is a plan view of a top loading rotor having an array of sample container carrier assemblies as shown in FIGS. 5 and 6.

An alternate embodiment of the invention is shown in FIGS. 5 through 7. In this embodiment the sample container 48 is carried by a sample container housing assembly 124 having a first and a second housing elements 126A and 126B respectively joined along a substantially radially, vertically extended jointure plane 128. The inner ends of the elements 126 may take any shape but are preferably flat, as at 130 (FIG. 7), to abut the core 14. The inner surface of each of the sample housing elements 126 contains a spherical surface 38' with a communicating rotation arresting surface 42'. When vertical surfaces 132A and 132B cooperate to define a guide slot which receives the pin 70 to guide the container 48 over a portion of its travel from the initial to the second position. In the embodiment of FIGS. 1 through 4 the guide slot may be defined using upwardly and radially outwardly slanting fins connected to the hub at each side of the channel 42 to define a guide slot which receives the pin 70 as the container 48 pivots and guides the pivoting motion over a portion of its travel from the initial to the second position. The vertical slot 132 communicates with the channel 42' to limit movement of the pin 70 on the container 48.

Cantilevered from the lower surface of each housing element is a resilient leg 134 which has defined, at the upper end thereof, the knife-like pivot support edge 104'. Each housing element 126 has a recessed portion 136 therein which, when conjoined, define a volume in which the sample container 48 may pivot. The leg 134 is designed to deflect to produce the action similar to that discussed in connection with the spring 100.

In the initial position (FIG. 5) the leg 134 is radially spaced by a distance 108' from the structure of the housing element 126 in which it is disposed. The sample container 48 is received on the pivot edges 104' of the spring legs 134 in each of the cooperating elements 126 and it is on these edges that the interruped line of contact 122 is defined on which the container 48 pivots from the first to the second position and, after a predetermined pivotal motion the pin 70 enters the guide slot 132. As the container 48 pivots the leg 134 deflects radially. Once the container reaches the second position continued rotation fo the rotor causes the spring legs 134 to continue deflecting radially outwardly thereby to close the distant 108' to bring the spherical bottom surface 58 of the container 48 into force transmissive contact with the housing 126 as shown by the character 123'' in FIG. 6.

The exterior of the sample container housing 126 is appropriately configured for receipt into the rotor. Any convenient configuration may be selected. In the embodiment shown in these FIGS. 5 through 7, the rotor includes a bowl-shaped receptacle 138 joined at its center to the core 14. The bowl-like receptacle 138 is provided with a cylindrical sidewall 142 which leads to a flared frustoconical surface 144. The exterior of the conjoined housing assembly 126 matches these contours. The cylindrical sidewall 142 defines a band 116' functionally similar to the band 116.

In view of the foregoing, those skilled in the art having the benefit of the teachings of the present invention as set forth herein may effect numerous modifications thereto. These modifications are, however to be construed as line within the scope of the present invention as set forth in the appended claims.

What is claimed is:

1. A centrifuge rotor for subjecting a sample of a material carried in a sample container to a centrifugal force field, the sample container having a pivot surface thereon, the rotor comprising:

a pair of sample container pivot elements disposed in circumferentially spaced spaced relationship around the rotor, each sample container pivot element having a thin knife edge arranged to receive the pivot surface of the sample container along a substantially line contact whereby the sample container is receivable within the rotor with any portion of the pivot surface received on the pivot elements.

2. The centrifuge rotor of claim 1 further comprising:

a guide slot disposed radially inwardly of the pivot elements to guide the sample container over a portion of its travel as the container pivots with rotation of the rotor on the line contact defined between the container and the pivot elements from an initial position in which the axis of the sample container is parallel to the vertical center line of the rotor to a second position in which the axis of the sample container is perpendicular to the vertical center line.

3. The centrifuge rotor of claim 2 wherein the rotor is surrounded by a circumferential band and wherein each pivot element is mounted to the rotor and designed to prevent the radially outer surface of the container from abutting in a force transmissive relationship with the band until the axis of the sample container is perpendicular to the vertical center line of the rotor.

4. The centrifuge rotor of claim 3 further comprising a stop surface communicating with the guide slot for prohibiting the pivotal movement of the sample container past the second position.

5. The centrifuge rotor of claim 4 wherein the pivot surface has a predetermined diametrical dimension associated therewith and wherein the line contact is substantially coincident with the diametrical dimension of the pivot surface.

6. The centrifuge rotor of claim 3 wherein the pivot surface has a predetermined diametrical dimension associated therewith and wherein the line contact is substantially coincident with the diametrical dimension of the pivot surface.

7. The centrifuge rotor of claim 2 further comprising a stop surface communicating with the guide slot for prohibiting the pivotal movement of the sample container past the second position.

8. The centrifuge rotor of claim 7 wherein the pivot surface has a predetermined diametrical dimension associated therewith and wherein the line contact is substantially coincident with the diametrical dimension of the pivot surface.

9. The centrifuge rotor of claim 2 wherein the pivot surface has a predetermined diametrical dimension associated therewith and wherein the line contact is substantially coincident with the diametrical dimension of the pivot surface.

10. The centrifuge rotor of claim 1 wherein the rotor is surrounded by a circumferential band and wherein each pivot element is mounted to the rotor and designed to prevent the radially outer surface of the container from abutting in a force transmissive relationship with the band until the axis of the sample container is perpendicular to the vertical center line of the rotor.

11. The centrifuge rotor of claim 10 wherein the pivot surface has a predetermined diametrical dimension associated therewith and wherein the line contact is substantially coincident with the diametrical dimension of the pivot surface.

12. The centrifuge rotor of claim 1 wherein the pivot surface has a predetermined diametrical dimension associated therewith and wherein the line contact is substantially coincident with the diametrical dimension of the pivot surface.

* * * * *